US006481834B2

(12) United States Patent
Takahashi et al.

(10) Patent No.: US 6,481,834 B2
(45) Date of Patent: Nov. 19, 2002

(54) INK-JET RECORDING HEAD

(75) Inventors: Tomoaki Takahashi, Nagano-Ken (JP); Takashi Nakamura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/832,351

(22) Filed: Apr. 11, 2001

(65) Prior Publication Data

US 2001/0052918 A1 Dec. 20, 2001

(30) Foreign Application Priority Data

Apr. 12, 2000 (JP) ..... 2000-110778
Mar. 30, 2001 (JP) ..... 2001-099750

(51) Int. Cl.[7] ..... B41J 2/045
(52) U.S. Cl. ..... 347/68
(58) Field of Search ..... 347/54, 68, 69, 347/70, 71

(56) References Cited

U.S. PATENT DOCUMENTS 5,640,184 A 6/1997 Moynihan et al. ..... 347/47
6,241,346 B1 * 6/2001 Takahashi ..... 347/70

FOREIGN PATENT DOCUMENTS

EP 0 786 346 A2 7/1997 ..... B41J/2/14
EP 0930169 A1 * 7/1999 ..... B41J/2/175
EP 0 931 650 A1 7/1999 ..... B41J/2/045
EP 0 972 643 A2 1/2000 ..... B41J/2/19
EP 0 985 535 A2 3/2000 ..... B41J/2/14

* cited by examiner

*Primary Examiner*—Anh T. N. Vo
(74) *Attorney, Agent, or Firm*—Sughrue Mion, PLLC

(57) ABSTRACT

A passage forming plate (1) is provided with a plurality of pressure chambers (5). A nozzle plate (2) is provided with nozzle holes (6). The nozzle plate (2) is disposed on the front surface (1*a*) of the passage forming plate (1) so that the nozzle holes (6) communicate with the pressure chambers (5), respectively. Pressure is applied to the ink in the pressure chambers (5) by piezoelectric vibrators (8). A casing member (3) with an ink reservoir (10) for containing the ink to be supplied to the pressure chambers (5) is disposed on the side of the back surface (1*b*) of the passage forming plate (1). A sealing plate (4) is held between the passage forming plate (1) and the casing member (3). The sealing plate (4) is provided with a plurality of through holes (18) communicating with the plurality of pressure chambers (5), respectively.

31 Claims, 7 Drawing Sheets

INK-JET RECORDING HEAD

BACKGROUND OF THE INVENTION

1. Field of the Invention

The present invention relates to an ink-jet recording head that jets ink particles through nozzle holes by applying pressure to the ink contained in pressure chambers by pressure producing elements.

2. Description of the Related Art

Generally, an ink-jet recording head includes an ink reservoir connected to an external ink tank, a plurality of pressure chambers communicating with the ink reservoir by means of ink inlets, pressure producing elements, such as piezoelectric vibrators or heating means, and a nozzle plate provided with nozzle holes through which the ink is jetted in ink particles.

FIG. 10 is a vertical sectional view of a conventional ink-jet recording head provided with longitudinal oscillation mode piezoelectric vibrators and FIG. 11 is a cross-sectional view taken on line A—A in FIG. 10.

Referring to FIG. 10, a conventional ink-jet recording head includes a passage forming plate 60, a nozzle plate 61 disposed on the front surface 60*a* of the passage plate 60, a casing member 62 disposed on the back surface 60*b* of the passage plate 60, and a sealing plate 63 held between the back surface 60*b* of the passage plate 60 and the casing member 62.

A plurality of pressure chambers 64 are formed in the passage forming plate 60. A plurality of nozzle holes 65 communicating with the pressure chambers 64, respectively, are formed in the nozzle plate 61. An ink reservoir 66 for containing ink to be supplied to the pressure chambers 64 is formed in the passage forming plate 60. The pressure chambers communicate with the ink reservoir 66 by means of ink inlets 67, respectively. The ink inlets 67 adjust the flow of the ink into the pressure chambers 64. The sealing plate 63 is attached hermetically to the back surface of the passage forming plate 60 to close the open back ends of the pressure chambers 64, the ink inlets 67 and the ink reservoir 66.

A plurality of piezoelectric vibrators 68 are housed in the casing member 62 so as to correspond to the plurality of pressure chambers 64, respectively. The piezoelectric vibrators 68 are held fixedly by a holding member 69 on the casing member 62.

The sealing plate 63 has a thick part 71 including a plurality of lands 70 connected to the plurality of piezoelectric vibrators 68, respectively, and a thin part 73 including elastically deformable parts 72 surrounding the lands 70, respectively. As shown in FIGS. 10 and 11, the thin part 73 is provided with a thin compliant part 74 of a shape substantially resembling that of the ink reservoir 66. An ink supply pipe 75 carries the ink into the ink reservoir 66. The ink supply pipe 75 penetrates the sealing plate 63 and opens into the ink reservoir 66. the ink supply pipe 75 is connected to a middle part of the elongate ink reservoir 66 in order that the ink supplied into the ink reservoir 66 is able to flow through the shortest possible distance to the extremities of the ink reservoir 66 and resistance against the flow of the ink is reduced to the least possible extent.

In this conventional ink-jet recording head, the sealing plate 63 must provide a part through which the ink supply pipe 75 extends and hence the thin compliant part 74 has a break in a middle part thereof, which affects adversely to the compliance of the compliant part 74.

Since the ink reservoir 66 is formed in the passage forming plate 60, the depth of the ink reservoir 66 cannot exceed the thickness of the passage forming plate 60. Therefore, if the ink-jet recording head is provided with a large number of nozzles and has a big length and the ink reservoir 66 has a big length, the width of the ink reservoir 66 needs to be increased to reduce resistance against the flow of the ink flowing toward the extremities of the ink reservoir 66. Consequently, the size of the ink-jet recording head is inevitably large.

SUMMARY OF THE INVENTION

The present invention has been made in view of the aforesaid problems and it is therefore an object of the present invention to provide an ink-jet recording head having high compliance and capable of being formed in a small size.

According to the present invention, an ink-jet recording head comprises: a passage forming plate provided with a plurality of pressure chambers; a nozzle plate disposed on one surface of the passage forming plate and provided with a plurality of nozzle holes respectively communicating with the plurality of pressure chambers; a plurality of pressure producing elements for applying pressure to ink contained in the plurality of pressure chambers; a casing member disposed on a side of the other surface of the passage forming plate and provided with an ink reservoir for containing the ink to be supplied to the plurality of pressure chambers; and a sealing plate disposed between the other surface of the passage forming plate and the casing member and connected to the plurality of pressure producing elements; wherein the sealing plate is provided with a plurality of through holes respectively communicating with both the plurality of pressure chambers and the ink reservoir.

Preferably, the plurality of through holes connected to the ink reservoir via a plurality of ink inlets, respectively, and wherein the ink inlets are capable of adjusting flow of ink between the ink reservoir and the pressure chambers.

Preferably, the sealing plate has a thick part including a plurality of lands connected to the piezoelectric vibrators, respectively, and a thin part including elastic parts capable elastic deformation and surrounding the lands.

Preferably, the plurality of ink inlets are formed in the thin part of the sealing plate.

Preferably, the sealing plate is formed by laminating a metal sheet and a polymer film, and the elastic parts are formed in the polymer film.

Preferably, the plurality of ink inlets are formed by etching the metal sheet.

Preferably, the plurality of through holes are formed by laser-machining portions of the polymer film corresponding to etched parts of the metal sheet.

Preferably, the sealing plate is formed by processing a plate member which can be elastically deformable at least by thinning.

Preferably, the plate member is a metal sheet, and the plurality of through holes are formed in the metal sheet by subjecting the metal sheet to press working.

Preferably, the plate member is a metal sheet, and the plurality of through holes are formed by etching the metal sheet.

Preferably, the plurality of ink inlets are recesses formed in a surface, which faces the sealing plate, of the casing member.

Preferably, the plurality of through holes are capable of adjusting flow of ink between the ink reservoir and the pressure chambers.

Preferably, the sealing plate has a thick part including a plurality of lands connected to the piezoelectric vibrators, respectively, and a thin part including elastic parts capable elastic deformation and surrounding the lands.

Preferably, the sealing plate is formed by laminating a metal sheet and a polymer film, and the elastic parts are formed in the polymer film.

Preferably, the plurality of through holes are formed by subjecting the sealing plate to press working.

Preferably, the plurality of through holes are formed by etching the metal sheet and laser-machining the polymer film.

Preferably, the sealing plate is formed by processing a plate member which can be elastically deformable at least by thinning.

Preferably, the plate member is a metal sheet, and the plurality of through holes are formed in the metal sheet by subjecting the metal sheet to press working.

Preferably, the plate member is a metal sheet, and the plurality of through holes are formed by etching the metal sheet.

Preferably, the ink reservoir has an outlet opening opened in a surface, which faces the sealing plate, of the casing member, a compliant part is formed in a part, corresponding to the outlet opening of the ink reservoir, of the sealing plate, and a compliance space is formed in a part of the passage forming plate corresponding to the compliant part to enable the compliant part to deform.

Preferably, the compliance space is opened to atmosphere.

Preferably, the ink reservoir has opposite end parts with respect to a direction in which the plurality of pressure chambers are arranged, and the opposite end parts have width decreasing toward their extremities.

Preferably, the ink reservoir has opposite end parts with respect to a direction in which the plurality pressure chambers are arranged, and depth of the opposite end parts decreases toward their extremities.

Preferably, the passage forming plate is a metal plate, and the plurality of pressure chambers are formed in the metal plate by press working.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
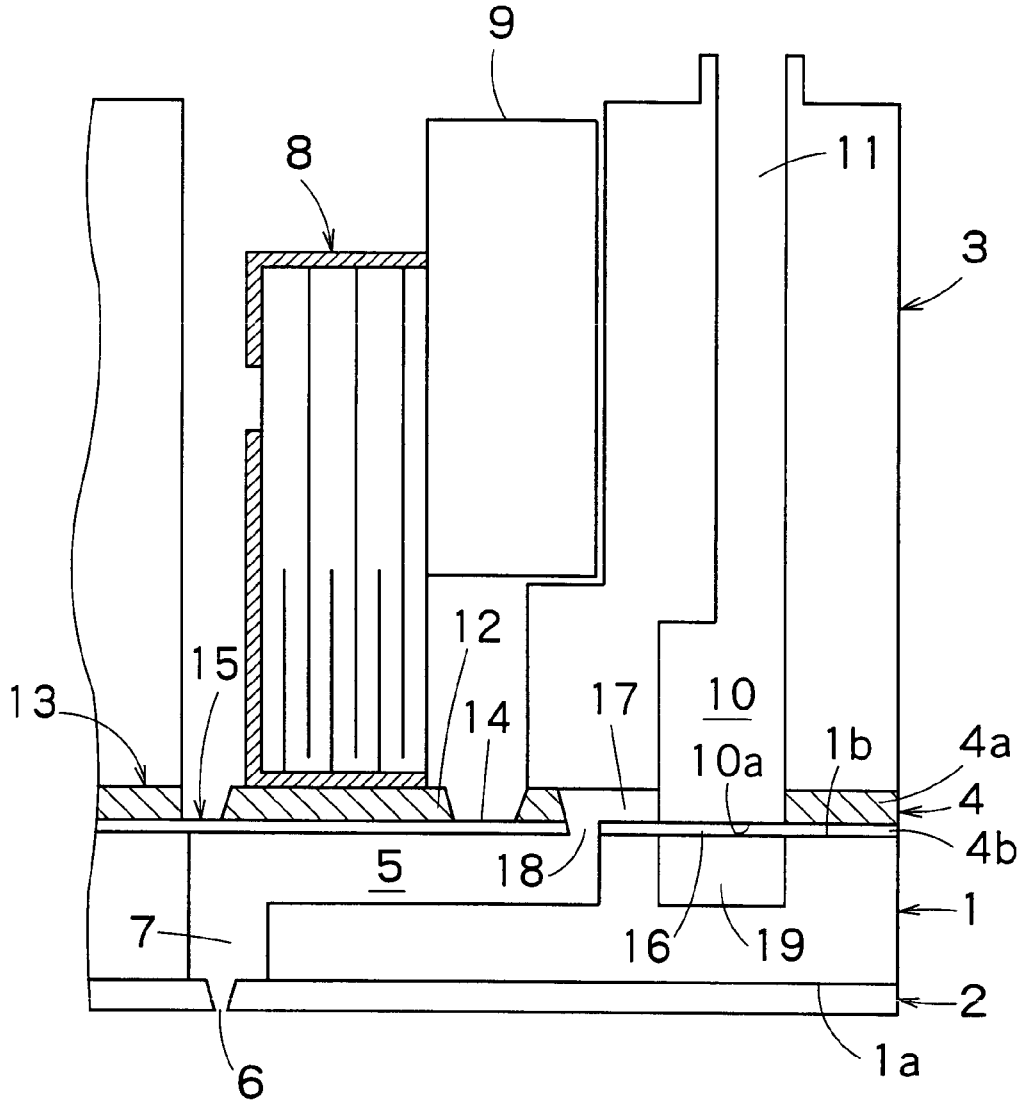
FIG. 1 is a vertical sectional view of an ink-jet recording head in a preferred embodiment according to the present invention.

Referring to FIG. 1 showing an ink-jet recording head in a preferred embodiment according to the present invention, the ink-jet recording head includes a passage forming plate 1, a nozzle plate 2 placed on the front surface 1*a* of the passage forming plate 1, a casing member 3 placed on the side of the back surface 1*b* of the passage forming plate 1, and a sealing plate 4 held between the back surface 1*b* of the passage forming plate 1 and the casing member 3.

Figure 2A:
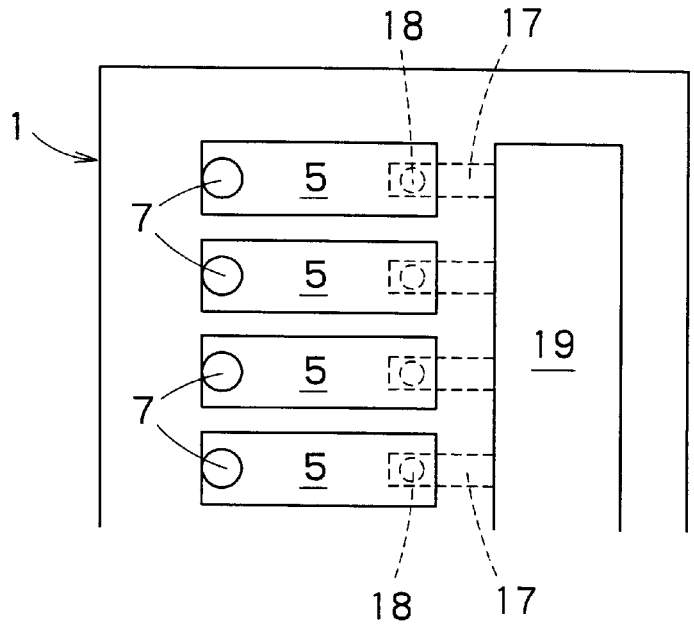
FIG. 2A is a fragmentary plan view of a passage forming plate included in the ink-jet recording head shown in FIG. 1.

As shown in FIGS. 1 and 2A, the passage forming plate 1 is provided with a plurality of pressure chambers 5, and the nozzle plate 2 is provided with a plurality of nozzle holes 6 respectively corresponding to the pressure chambers 5. The nozzle holes 6 communicate with the pressure chambers 5 by means of connecting holes 7, respectively.

A plurality of piezoelectric vibrators 8, i.e., pressure producing elements that apply pressure to the ink contained in the plurality of pressure chambers 5, are contained in the casing member 3 so as to correspond to the pressure chambers 51 respectively. The piezoelectric vibrators 8 are held fixedly on the casing member 3 by a holding member 9.

An ink reservoir 10 for storing ink to be supplied to the plurality of pressure chambers 5 is formed in the casing member 3. An ink supply pipe 11 is connected to the ink reservoir 10. The ink reservoir 10 has an outlet opening 10*a* which opens in a surface facing the sealing plate 4.

Figure 2B:
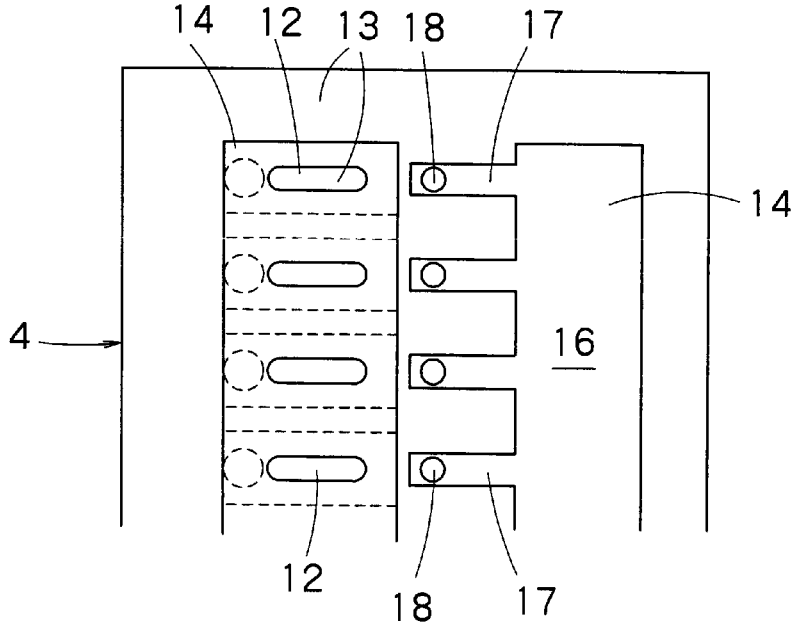
FIG. 2B is a fragmentary plan view of a sealing plate included in the ink-jet recording head shown in FIG. 1.

The sealing plate 4 has a thick part 13 including a plurality of lands 12 connected to the piezoelectric vibrators 8, respectively, and a thin part 15 including elastic parts 14 capable elastic deformation. As shown in FIGS. 1 and 2B, the thin part 15 of the sealing plate 4 has a compliant part (thin part) 16 for absorbing the variation of ink pressure. The compliant part 16 has a shape substantially the same as that of the outlet opening 10*a* of the ink reservoir 10. The open upper ends of the pressure chambers 5 and the compliant part 16 are closed hermetically by the sealing plate 4.

A compliance space 19 is formed in a part of the passage forming plate 1 corresponding to the compliant part 16 to enable the compliant part 16 to deform. Preferably, the compliance space 19 is opened to the atmosphere to ensure the deformation of the compliant part 16 in the compliance space 19.

A plurality of ink inlets 17 are formed in the part 15 of the sealing plate 4 to connect the ink reservoir 10 to the pressure chambers 5. The plurality of ink inlets 17 are connected to the pressure chambers 5 by the connecting holes 18 formed in the thin part 15 in which the ink inlets 17 are formed, respectively. The ink inlets 17 adjust the flow of the ink between the ink reservoir 10 and the pressure chambers 5.

As shown in FIG. 1, the sealing plate 4 is formed, for example, by laminating a metal sheet 4*a*, such as a stainless steel sheet, provided with the lands 12, and a polymer film 4*b* having the elastic parts 14. The ink inlets 17 can be formed by etching the metal plate 4*a*, and the connecting holes 18 can be formed by subjecting parts of the polymer film 4*b* corresponding to etched parts of the metal plate 4*a* to laser processing.

It is also possible to form the sealing plate 4 from a single metal sheet which can be elastically deformable at least by thinning. In this case, the connecting holes 18 can be formed by subjecting the metal sheet to either press working or etching.

When manufacturing the passage forming plate 1, the plurality of pressure chambers 5 and the compliance space 19 can be formed by subjecting a metal sheet to press working.

The casing member 3 may be formed by injection molding.

The ink-jet recording head in this embodiment has the casing member 3 provided with the ink reservoir 10 and the pressure chambers 5 communicate with the ink reservoir 10 by means of the ink inlets 17 and the connecting holes 18 of the sealing plate 4. Thus, the ink reservoir 10 can be designed in a desired shape and a desired depth without restraint. Therefore, when the number of the nozzles holes 6 is increased, the resistance of the ink reservoir 10 against the flow of the ink can be reduced by increasing the depth of the reservoir 10 without increasing the width of the same. As a result, the enlargement of the ink-jet recording head can be avoided. The ink-jet recording head of the present embodiment can be smaller than the conventional ink-jet recording head having the same number of nozzle holes.

Since the ink reservoir 10 is formed in the casing member 3 and the ink reservoir 10 is connected to the pressure chambers 5 by the ink inlets 17 and the connecting holes 18, any connecting passage for connecting the ink reservoir 10 to the ink supply pipe 11 does not need to be formed in the sealing plate 4 and the passage forming plate 1. Therefore, the compliant part 16 can be extended over the entire ink reservoir 10 to enhance compliance for absorbing the pressure variation of the ink.

Since the ink inlets 17 capable of adjusting the flow of the ink between the ink reservoir 10 and the pressure chamber 5 are formed in the sealing plate 4 separate from the passage forming plate 1, the design flexibility of the ink inlets 17 is improved.

Figure 3:
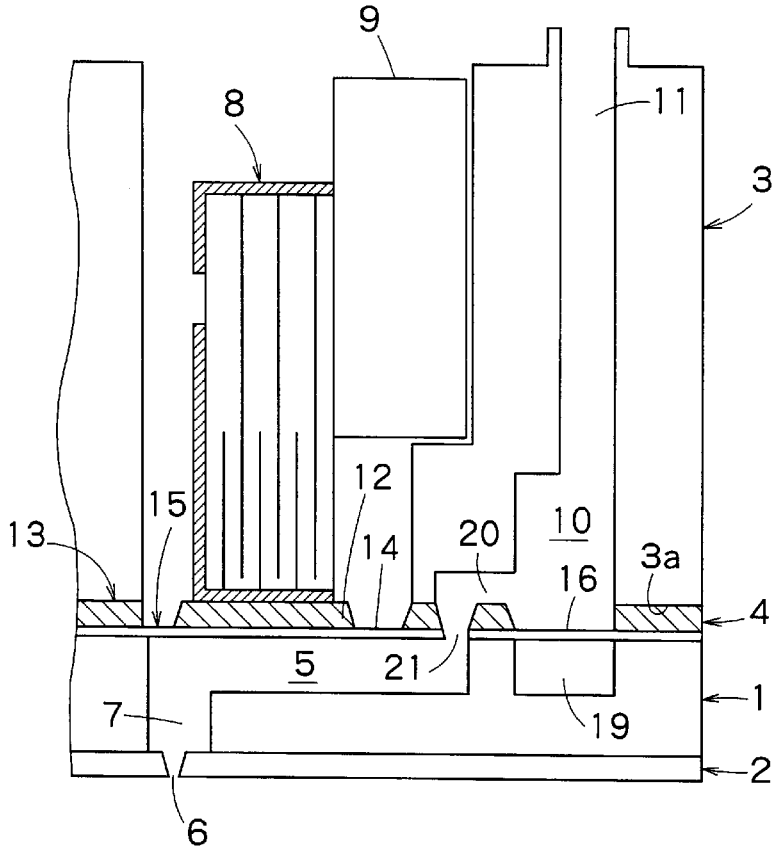
FIG. 3 is a vertical sectional view of an ink-jet recording head in a first modification of the ink-jet recording head shown in FIG. 1.

An ink-jet recording head in a first modification of the ink-jet recording head in the aforesaid embodiment will be described with reference to FIG. 3.

The ink-jet recording head in the first modification differs from the aforesaid embodiment in the position of ink inlets. In the aforesaid embodiment, the ink inlets 17 are formed in the thin part 15 of the sealing plate 4 as shown in FIG. 1. The first modification is provided with ink inlets 20 defined by grooves formed in a surface 3*a*, which faces a sealing plate 4, of a casing member 3 as shown in FIG. 3. Connecting holes 21 are formed through a thick part 13 of the sealing plate 4.

The ink inlets 20 of the first modification can be formed when forming the casing member 3 by injection molding, which facilitates the fabrication of the ink-jet recording head.

An ink-jet recording head in a second modification of the ink-jet recording head in the aforesaid embodiment will be described with reference to FIG. 4.

Figure 4:
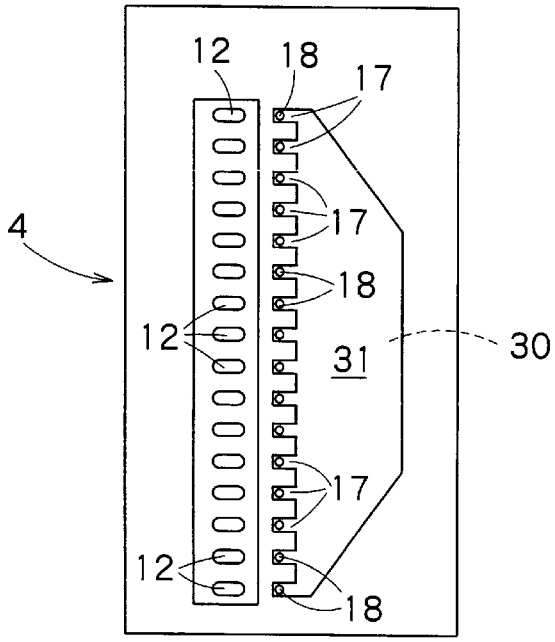
FIG. 4 is a schematic plan view of a sealing plate included in an ink-jet recording head in a second modification of the ink-jet recording head shown in FIG. 1.

FIG. 4 is a plan view of a sealing plate 4 included in the second modification. As shown in FIG. 4, an ink reservoir 30 and a compliant part 31 have opposite end parts tapered toward the ends, respectively. Thus, when bubbles are entrapped in the ink contained in the ink reservoir 30, the stagnation of the bubbles in the opposite end parts of the ink reservoir 30 can be prevented.

An ink-jet recording head in a third modification of the ink-jet recording head in the aforesaid embodiment will be described with reference to FIGS. 5, 6 and 7.

Figure 5:
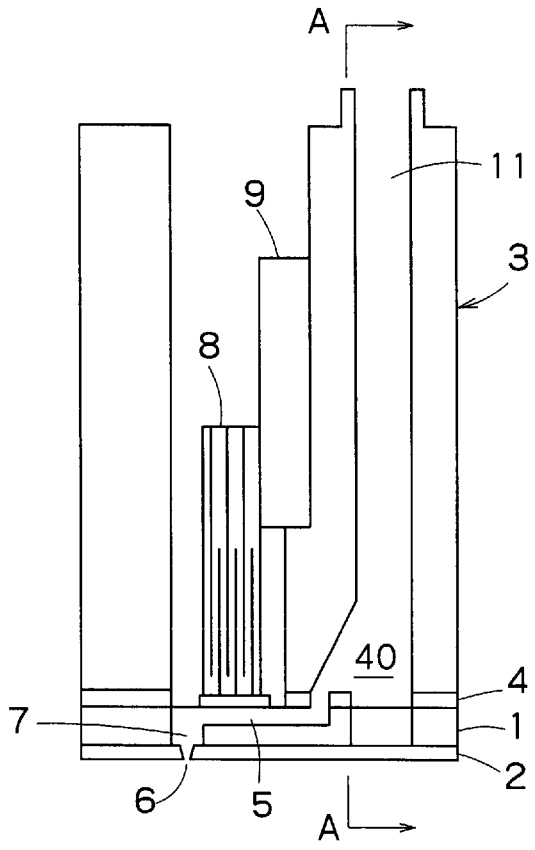
FIG. 5 is a vertical sectional view of an ink-jet recording head in a third modification of the ink-jet recording head shown in FIG. 1.
Figure 6:
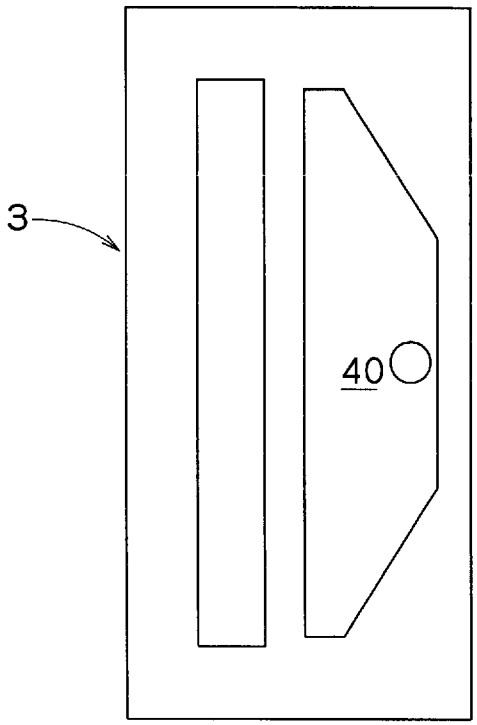
FIG. 6 is a schematic plan view of a casing member included in the ink-jet recording head shown in FIG. 5.
Figure 7:
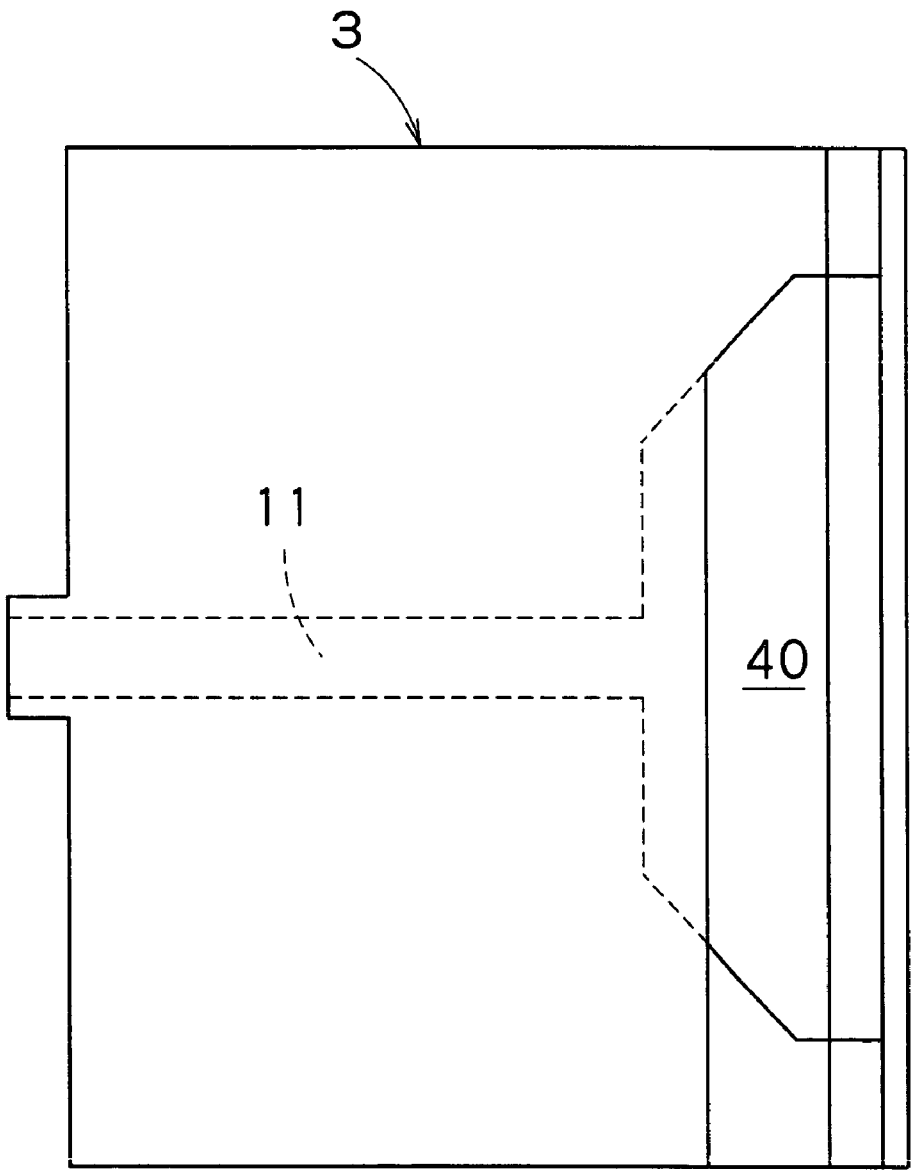
FIG. 7 is a vertical sectional view taken on line A—A in FIG. 5.

FIG. 5 is a vertical sectional view of an ink-jet recording head in the third modification, FIG. 6 is a plan view of a casing member 3 included in the ink-jet recording head shown in FIG. 5, and FIG. 7 is a schematic sectional view taken on line A—A in FIG. 5. An ink reservoir 40 and a compliant part 41 corresponding to the ink reservoir 40 of the third modification, similarly to those of the second modification, have opposite end parts tapered toward the ends, respectively. Moreover, the depth of the ink reservoir 40 is reduced in the opposite end parts of the ink reservoir 40. Thus, when bubbles are formed in the ink contained in the ink reservoir 40, the stagnation of the bubbles in the opposite end parts of the ink reservoir 40 can be surely prevented.

Figure 8:
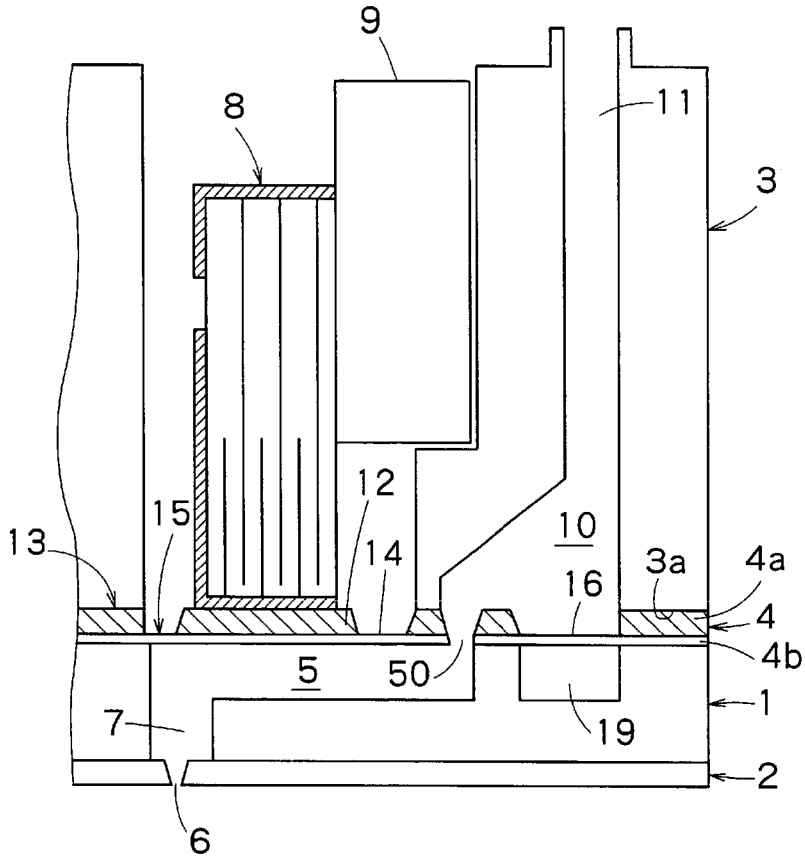
FIG. 8 is a vertical sectional view of an ink-jet recording head in a fourth modification of the ink-jet recording head shown in FIG. 1.
Figure 9:
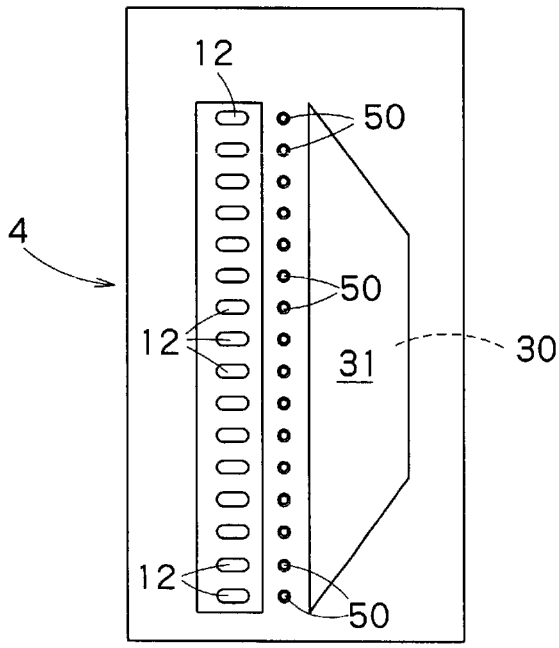
FIG. 9 is a schematic plan view of a sealing plate included in the ink-jet recording head shown in FIG. 8.
Figure 10:
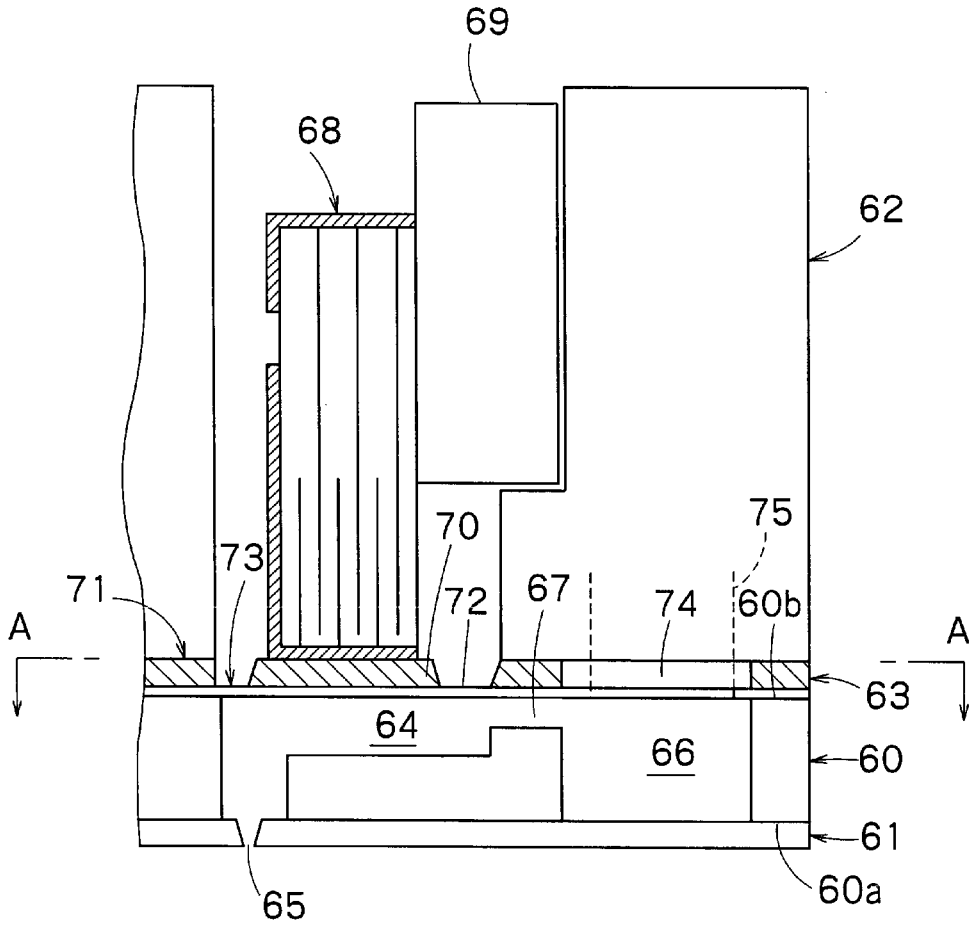
FIG. 10 is a vertical sectional view of a conventional ink-jet recording head.
Figure 11:
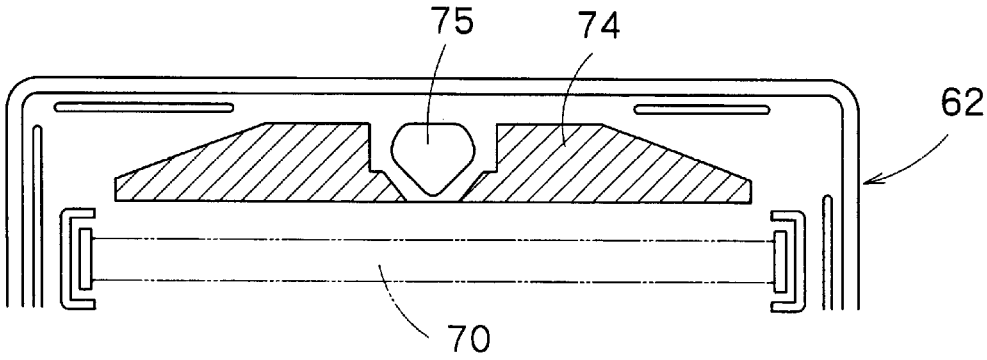
FIG. 11 is a cross-sectional view taken on line A—A in FIG. 10.

An ink-jet recording head in a fourth modification of the ink-jet recording head in the aforesaid embodiment will be described with reference to FIGS. 8 and 9.

A sealing plate 4 included in the ink-jet recording head in the fourth modification is provided with a plurality of through holes 50 respectively connected to a plurality of pressure chambers 5. The through holes 50 are capable of adjusting the flow of the ink between an ink reservoir 10 and the pressure chambers 5. In the fourth modification, the through holes 50 formed in the sealing plate 4 exercise the flow adjusting function of the ink inlets of the ink-jet recording head shown in FIG. 1. Therefore, the fourth modification does not need any ports corresponding to the ink inlets 17 of the ink-jet recording head shown in FIG. 1.

The sealing plate 4 of the fourth modification, similarly to that of the ink-jet recording head shown in FIG. 1, may be formed by laminating a metal sheet 4*a*, such as a stainless steel 10 sheet, provided with lands 12, and a polymer film 4*b* having elastic parts 14. The through holes 50 may be formed by subjecting the sealing plate 4 formed by laminating the metal plate 4*a* and the polymer film 4*b* to press working.

The through hole 50 may be formed by etching the metal plate 4*a* and subjecting the polymer film 4*b* to laser machining.

The sealing plate 4 may be a single metal plate. When the sealing plate 4 is a single metal plate, the through holes 50 may be formed by either press working or etching.

The ink-jet recording head in the fourth modification exercises the same effect as the ink-jet recording head in the aforesaid embodiment shown in FIG. 1. Since the through holes 50 capable of adjusting the flow of the ink between the ink reservoir 10 and the pressure chambers 5 are formed in the sealing plate 4 separate from a passage forming plate 1, the design flexibility of the through holes 50 is improved.

As apparent from the foregoing description, since the ink-jet recording head according to the present invention has the casing member provided with the ink reservoir, and the ink reservoir and the pressure chambers are connected by the through holes formed in the sealing plate, the ink reservoir can be formed in a desired depth and a desired shape without restraint. Accordingly, even if the number of the nozzle holes is increased, the resistance of the ink reservoir against the flow of the ink can be reduced by increasing the depth of the reservoir without increasing the width of the same.

Therefore, the enlargement of the ink-jet recording head can be avoided. The ink-jet recording head of the present invention can be smaller than the conventional ink-jet recording head having the same number of nozzle holes. The compliant part can be extended over the entire ink reservoir, and hence compliance for absorbing the pressure variation of the ink can be enhanced.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An ink-jet recording head comprising:

a passage forming plate provided with a plurality of pressure chambers;

a nozzle plate disposed on one surface of the passage forming plate and provided with a plurality of nozzle holes respectively communicating with the plurality of pressure chambers;

a plurality of pressure producing elements for applying pressure to ink contained in the plurality of pressure chambers;

a casing member disposed on a side of the other surface of the passage forming plate and provided with an ink reservoir for containing the ink to be supplied to the plurality of pressure chambers; and a sealing plate disposed between the other surface of the passage forming plate and the casing member and connected to the plurality of pressure producing elements;

wherein the sealing plate is provided with a plurality of through holes respectively communicating with both the plurality of pressure chambers and the ink reservoir.

2. The ink-jet recording head according to claim 1, wherein the plurality of through holes connected to the ink reservoir via a plurality of ink inlets, respectively, and wherein the ink inlets are capable of adjusting flow of ink between the ink reservoir and the pressure chambers.

3. The ink-jet recording head according to claim 2, wherein the sealing plate has a thick part including a plurality of lands connected to the piezoelectric vibrators, respectively, and wherein a thin part including elastic parts capable elastic deformation and surrounding the lands.

4. The ink-jet recording head according to claim 3, wherein the plurality of ink inlets are formed in the thin part of the sealing plate.

5. The ink-jet recording head according to claim 3, wherein the sealing plate is formed by laminating a metal sheet and a polymer film, and wherein the elastic parts are formed in the polymer film.

6. The ink-jet recording head according to claim 5, wherein the plurality of ink inlets are formed by etching the metal sheet.

7. The ink-jet recording head according to claim 6, wherein the plurality of through holes are formed by laser-machining portions of the polymer film corresponding to etched parts of the metal sheet.

8. The ink-jet recording head according to claim 2, wherein the plurality of ink inlets are recesses formed in a surface, which faces the sealing plate, of the casing member.

9. The ink-jet recording head according to claim 2, wherein the sealing plate is formed by processing a plate member which can be elastically deformable at least by thinning.

10. The ink-jet recording head according to claim 9, wherein the plate member is a metal sheet, and wherein the plurality of through holes are formed in the metal sheet by subjecting the metal sheet to press working.

11. The ink-jet recording head according to claim 9, wherein the plate member is a metal sheet, and wherein the plurality of through holes are formed by etching the metal sheet.

12. The ink-jet recording head according to claim 1, wherein the plurality of through holes are capable of adjusting flow of ink between the ink reservoir and the pressure chambers.

13. The ink-jet recording head according to claim 12, wherein the sealing plate has a thick part including a plurality of lands connected to the piezoelectric vibrators, respectively, and a thin part including elastic parts capable elastic deformation and surrounding the lands.

14. The ink-jet recording head according to claim 12, wherein the sealing plate is formed by laminating a metal sheet and a polymer film, and wherein the elastic parts are formed in the polymer film.

15. The ink-jet recording head according to claim 14, wherein the plurality of through holes are formed by subjecting the sealing plate to press working.

16. The ink-jet recording head according to claim 14, wherein the plurality of through holes are formed by etching the metal sheet and laser-machining the polymer film.

17. The ink-jet recording head according to claim 12, wherein the sealing plate is formed by processing a plate member which can be elastically deformable at least by thinning.

18. The ink-jet recording head according to claim 17, wherein the plate member is a metal sheet, and wherein the plurality of through holes are formed in the metal sheet by subjecting the metal sheet to press working.

19. The ink-jet recording head according to claim 17, wherein the plate member is a metal sheet, and wherein the plurality of through holes are formed by etching the metal sheet.

20. The ink-jet recording head according to claim 1, wherein the ink reservoir has an outlet opening opened in a surface, which faces the sealing plate, of the casing member, wherein a compliant part is formed in a part, corresponding to the outlet opening of the ink reservoir, of the sealing plate, and wherein a compliance space is formed in a part of the passage forming plate corresponding to the compliant part to enable the compliant part to deform.

21. The ink-jet recording head according to claim 20, wherein the compliance space is opened to atmosphere.

22. The ink-jet recording head according to claim 1, wherein the ink reservoir has opposite end parts with respect to a direction in which the plurality of pressure chambers are arranged, and the opposite end parts have width decreasing toward their extremities.

23. The ink-jet recording head according to claim 1, wherein the ink reservoir has opposite end parts with respect to a direction in which the plurality pressure chambers are arranged, and depth of the opposite end parts decreases toward their extremities.

24. The ink-jet recording head according to claim 1, wherein the passage forming plate is a metal plate, and wherein the plurality of pressure chambers are formed in the metal plate by press working.

25. The ink-jet recording head according to claim 1, wherein the plurality of through holes directly communicate with the plurality of pressure chambers, respectively.

26. The ink-jet recording head according to claim 25, wherein the plurality of through holes directly communicate with the ink reservoir.

27. The ink-jet recording head according to claim 1, wherein the plurality of through holes directly communicate with the ink reservoir.

28. An inkjet recording head comprising:

a passage forming plate provided with a plurality of pressure chambers;

a nozzle plate disposed on one side of the passage forming plate and provided with a plurality of nozzle holes respectively communicating with the plurality of pressure chambers;

a plurality of pressure producing elements for applying pressure to ink contained in the plurality of pressure chambers;

a casing member disposed on a second side of the passage forming plate and provided with at least one ink reservoir containing the ink to be supplied to the plurality of pressure chambers; and a sealing plate disposed between the second side of the passage forming plate and the casing member, wherein the sealing plate is provided with a plurality of through holes respectively communicating with both the plurality of pressure chambers and communicating with the at least one ink reservoir.

29. The inkjet recording head according to claim 28, wherein the plurality of through holes directly communicate with the plurality of pressure chambers, respectively.

30. The ink-jet recording head according to claim 29, wherein the plurality of through holes directly communicate with the at least one ink reservoir.

31. The ink-jet recording head according to claim 28, wherein the plurality of through holes directly communicate with the at least one ink reservoir.

* * * * *